US005457522A

United States Patent [19]

Haneda et al.

[11] Patent Number: 5,457,522

[45] Date of Patent: Oct. 10, 1995

[54] CHARGING UNIT WITH VARIABLE AC VOLTAGE

[75] Inventors: Satoshi Haneda; Kunio Shigeta; Sachie Hosogoezawa; Hiroyuki Nomori, all of Hachioji, Japan

[73] Assignee: Konica Corporation, Tokyo, Japan

[21] Appl. No.: 228,966

[22] Filed: Apr. 18, 1994

[30] Foreign Application Priority Data

Apr. 28, 1993 [JP] Japan ..... 5-102713

[51] Int. Cl.[6] ..... G03G 15/02

[52] U.S. Cl. ..... 355/219; 361/225

[58] Field of Search ..... 355/219, 305, 355/270, 251; 361/225, 229, 230, 233, 235, 220, 221; 430/125, 902

[56] References Cited

U.S. PATENT DOCUMENTS

| | | | |
|---|---|---|---|
| 4,174,903 | 11/1979 | Snelling | 118/657 X |
| 4,456,825 | 6/1984 | Kuge et al. | 250/324 |
| 4,922,299 | 5/1990 | Uchimoto et al. | 355/219 |
| 5,164,779 | 11/1992 | Araya et al. | 355/219 |
| 5,305,177 | 4/1994 | Aoki et al. | 361/225 |
| 5,307,122 | 4/1994 | Ohno et al. | 355/245 |
| 5,351,109 | 9/1994 | Haneda | 355/219 |

*Primary Examiner*—A. T. Grimley
*Assistant Examiner*—T. A. Dang
*Attorney, Agent, or Firm*—Frishauf, Holtz, Goodman, Langer & Chick

[57] ABSTRACT

An image forming apparatus uses a contact-type charger to charge a photoreceptor. The D.C. current supplied to the charger is measured while the output value of the A.C. voltage is changed within a predetermined range, and the output value of the A.C. voltage is set in accordance with the measurement result.

12 Claims, 4 Drawing Sheets

CHARGING UNIT WITH VARIABLE AC VOLTAGE

BACKGROUND OF THE INVENTION

The present invention relates to a charging member which is incorporated in an image forming apparatus such as an electrophotographic copying machine and an electrostatic recording apparatus and electrifies an image forming object, and more preferably to a charging unit of a magnetic brush type.

Heretofore, a corona charging unit has generally been used for charging of an image forming object such as a photoreceptor drum in an image forming apparatus of an electrophotographic type. In the corona charging unit, high voltage is impressed on a corona wire to generate an intensive electric field around the corona wire for gas discharge, and charged ions generated on that occasion are adsorbed on the image forming object which is thus charged.

The conventional corona charging unit used in an electrophotographic image forming apparatus as those mentioned above does not come into contact with an image forming object mechanically for charging, and therefore, it has an advantage that it does not hurt the image forming object when charging. However, it has disadvantages that there are risks of an electric shock and a leak, while ozone caused by gas discharge is harmful for the human body and it shortens a life of an image forming object. Further, charging voltage by means of a corona charging unit is intensely affected by temperature and humidity and therefore is unstable, noise is further produced by high voltage in the corona charging unit, and a period of time of 5 seconds or more is needed for obtaining stable charging voltage after inputting high voltage, which are serious disadvantages when an electrophotographic image forming apparatus is utilized as a communication terminal and an information processing apparatus.

Main cause for the various disadvantages of the corona charging unit mentioned above lies in that charging is carried out mainly through gas discharge.

Accordingly, as a charging unit capable of charging the image forming object without requiring high voltage gas discharge as in a corona charging unit and without hurting the image forming object mechanically, Japanese Patent Publication Open to Public Inspection No. 133569/1984 (hereinafter referred to as Japanese Patent O.P.I. Publication) discloses a charging unit wherein magnetic particles are adsorbed on a cylindrical magnetic-particle-carrier housing therein magnets for forming a magnetic brush thereon and the magnetic brush rubs the surface of an image forming object for charging while D.C. bias voltage is impressed.

Since the magnetic brush mentioned above is a flexible brush composed of magnetic particles, it can charge without hurting an image forming object and has an advantage over other contact type charging units such as a fur brush charging unit and a charging unit employing a conductive and elastic roll. However, even when the magnetic brush charging unit mentioned above is used, uniform charging has not necessarily been attained.

Accordingly, magnetic brush charging methods wherein A.C. bias voltage containing D.C. components is applied on a magnetic brush for charging are disclosed in Japanese Patent O.P.I. Publication Nos. 21873/1992 and 116674/1992 which describe that the aforesaid A.C. bias voltage is impressed and thereby uniform charging can be given to an image forming object.

Even in the case of the charging method described in the aforesaid official gazette, breakdown is caused, magnetic particles are stuck on an image forming object or sufficient charges are not injected in magnetic particles, resulting in occurrence of uneven charging, if appropriate peak-to-peak voltage $V_{P\text{-}P}$ is not set.

However, appropriate peak-to-peak voltage $V_{P\text{-}P}$ is varied by environmental change. Therefore, when setting to the specific peak-to-peak voltage $V_{P\text{-}P}$, magnetic particles are caused to have high electric resistance so that magnetic particles tend to adhere to an image forming object when temperature and humidity are low, while when temperature and humidity are high, magnetic particles are caused to have low electric resistance, resulting in occurrence of breakdown, which have been problems.

In Japanese Patent O.P.I. Publication No. 267667/1989, there is further disclosed a technology wherein bias voltage composed of D.C. constant voltage and A.C. voltage in which peak-to-peak voltage $V_{P\text{-}P}$ is set so that specific A.C. components therein may be constant current is impressed on a charging unit. However, even when A.C. components are made to be constant current, optimum peak-to-peak voltage $V_{P\text{-}P}$ for an image forming object varies depending on difference of variation in an image forming object and a charging member themselves, and therefore satisfactory charging can not sometimes be obtained, which has been a problem.

SUMMARY OF THE INVENTION

An object of the invention is to solve the aforementioned problems and to provide a charging unit that can show excellent charging capability despite low temperature and low humidity or high temperature and high humidity and despite difference of characteristics caused by difference of variation in an image forming object and a charging member.

Further object of the invention is to solve the problems mentioned above and to provide a contact type charging member capable of charging uniformly at high speed without causing uneven charging or breakdown against an image forming object despite low temperature and low humidity or high temperature and high humidity, and especially preferably, to provide a charging unit wherein a magnetic brush is used.

Objects mentioned above can be achieved by detecting the conditions of optimum A.C. voltage and by setting optimum A.C. voltage in a charging member that comes into contact with an image forming object, and especially preferably in a charging unit wherein bias voltage containing D.C. components and A.C. components is impressed, for charging, on a magnetic brush composed of magnetic particles formed on a sleeve.

Incidentally, the charging member coming into contact with an image forming object may also be a semi-conductive roller or a fur brush which touches the image forming object or rotates.

Further, it is possible to change charging voltage on an image forming object by modifying a voltage value of D.C. components. Therefore, it is further possible to change the charging voltage on the image forming object so that the optimum conditions may be obtained.

In the present invention, a voltage of A.C. components is adjusted so that a current value of D.C. components shown when a bias voltage is impressed on a magnetic brush may be constant. Therefore, it is possible to keep the constant charging voltage without being affected by changes in environmental conditions of magnetic particles and changes in resistance caused by entrance of toner and thereby to impress an optimum A.C. voltage, resulting in no occurrence of adhesion of magnetic particles on an image forming object, uneven charging and breakdown.

BRIEF DESCRIPTION OF THE DRAWINGS

FIG. 4(*b*) is a graph showing relationship between A.C. component voltage of bias voltage and D.C. current.

DETAILED DESCRIPTION OF THE PREFERRED EMBODIMENT

(EXAMPLE 1)

Examples of the invention will be explained as follows, referring to drawings.

Figure 1:
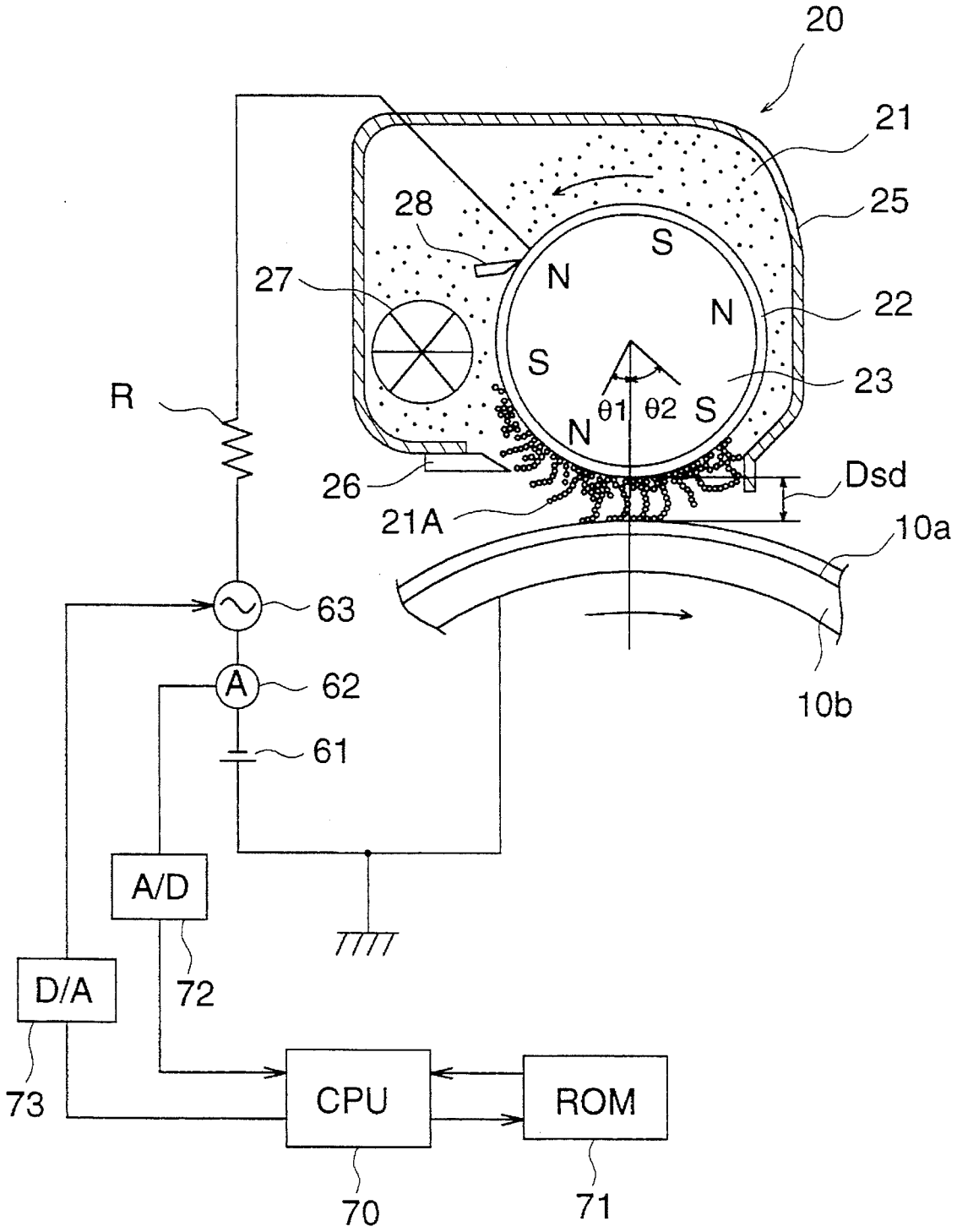
FIG. 1 is an enlarged sectional view showing an example of a charging unit of the invention.
Figure 3:
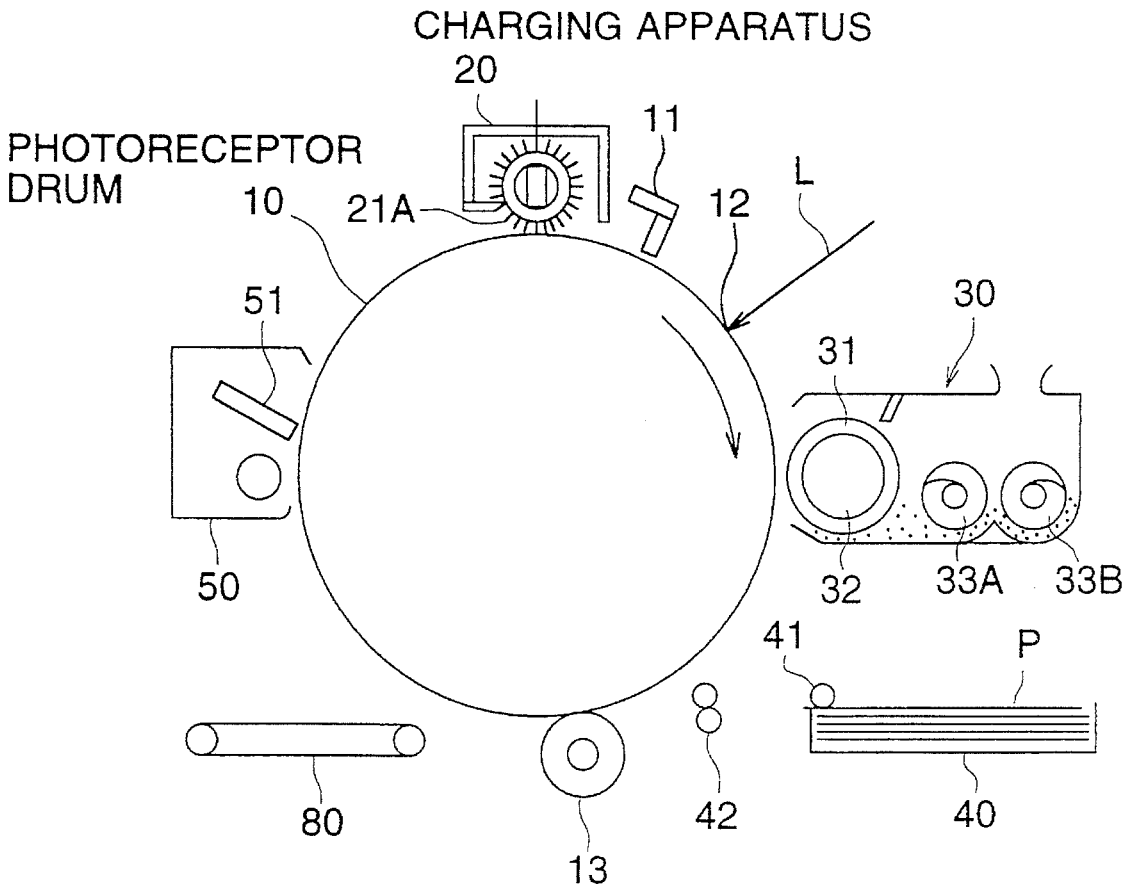
FIG. 3 is a schematic sectional view showing an image forming apparatus equipped with a charging unit of the invention.

FIG. 1 is an enlarged sectional view showing an example of a charging unit of the invention, FIG. 3 is a rough sectional view of a copying machine which is an image forming apparatus equipped with a charging unit of the invention, and FIG. 5 is a graph showing the preferable range of A.C. components in a bias voltage to be impressed on a charging sleeve of the charging unit.

In FIG. 3, the numeral 10 is a photoreceptor drum which is an image forming object rotating at a peripheral speed of 240 mm/sec in the arrowed (clockwise) direction. It is a negatively-charged photoreceptor drum comprising a conductive base board made of aluminum or the like having thereon an OPC light-sensitive layer consisting of a subbing layer, a charge-generating layer and a charge-transport layer in this order. Around the photoreceptor drum, there are provided charging unit 20, neutralizing unit 11, exposure section 12 where image light L enters, developing unit 30, transfer roller 13 and cleaning unit 50 all of which will be described later. The neutralizing unit 11 is composed of an LED array, for example, and is driven through the control of a controlling unit to neutralize charges on a frame portion outside an incidence area for image light L on the surface of photoreceptor drum 10.

Image light L is projected on the charged surface of the photoreceptor drum 10 by a slit exposure unit and a laser beam scanner and thereby an electrostatic latent image is formed. The electrostatic latent image is then subjected to regular development or reversal development conducted by developing unit 30 wherein toner charged to be of the polarity opposite to or identical to that of the photoreceptor drum is used.

Developing unit 30 in an illustrated example is a developing unit of a magnetic brush type wherein a magnetic brush composed of two-component developer that is a mixture of toner and magnetic carrier is formed on developing sleeve 31 and is transported in the arrowed direction, and bias voltage whose polarity is opposite to that on the photoreceptor drum 10 is impressed on the developing sleeve 31 fro the development for the purpose of prevention of a gray background in the case of regular development, or for the purpose of urging toner to stick to the electrostatic image in the case of reversal development. The developing unit may also be one wherein mono-component developer is used, or it may be one of a non-contact development type wherein a developer layer that does not come into contact with the photoreceptor drum 10 is formed on the developer sleeve 31 and is transported, and A.C. components are added to bias voltage to be impressed on the developing sleeve 31 and thereby toner flies from the developer layer to stick to the electrostatic image in the developing area where the developing sleeve 31 approaches the photoreceptor drum 10.

In the basic operation of a process in the present example, when the command for start printing is sent from an unillustrated operation section to an unillustrated control section, the photoreceptor drum 10 is controlled by the control section to start rotating in the arrowed direction. As the photoreceptor drum 10 rotates, the circumferential surface thereof is charged uniformly by charging unit 20 of a magnetic brush type stated later and passes through it. On the photoreceptor drum 10, writing of an image by means of image light L is carried out in exposure area 12 and thereby an electrostatic latent image corresponding to the image is formed. The electrostatic latent image is developed by developing unit 30, thus a toner image is formed on the photoreceptor drum 10.

On the other hand, recording sheet P is fed out from sheet-feeding cassette 40 one by one by first sheet-feeding roller 41. The recording sheet P thus fed out is conveyed onto the photoreceptor drum 10 by second sheet-feeding roller 42 that operates in synchronization with the aforementioned toner image on the photoreceptor drum 10. Due to operation of transfer roller 13 on which bias voltage is impressed from an unillustrated power supply, the toner image on the photoreceptor drum 10 is separated therefrom and is transferred onto recording sheet P. The recording sheet P onto which the toner image has been transferred is conveyed, through conveyance means 80, to an unillustrated fixing unit wherein the recording sheet is interposed between a heat-fixing roller and a pressure-contact roller to be subjected to fusion fixing, and is ejected out of an apparatus. The surface of the photoreceptor drum 10 rotating while holding residual toner that stays on the surface without being transferred onto the recording sheet P is cleaned to be on the state of standby by cleaning unit 50 provided with blade 51 or the like so that the residual toner may be scraped off.

Next, a particle size of a magnetic particle and general conditions of a magnetic-particle-carrier for magnetic particles used for charging unit 20 of the invention will be explained as follows.

When an average particle size (average by weight) of a magnetic particle is large, (a) unevenness tends to appear on a magnetic brush generally, resulting in a problem of uneven charging even when charging while giving vibration by means of an electric field, because bristles of a magnetic brush formed on a magnetic-particle-carrier are coarse. A method for solving this problem is to make an average particle size of magnetic particles small. Results of experiments show that the effect starts appearing when the average particle size is 200 μm or less, and when the average particle size is 150 μm or less, in particular, the problem of (a) is not substantially caused. However, when a particle is too small, the particle sticks to the surface of the photoreceptor drum 10, or tends to scatter, when charging. These phenomena depend on the intensity of a magnetic field acting on particles and on the intensity of magnetization of the particles caused by the magnetic field. In general, the phenomenon clearly appears when the average particle size is 30 μm or less. Incidentally, the intensity of magnetization ranging from 20 emu/g to 200 emu/g is used preferably.

From the foregoing, an average particle size (average by weight) of 150 μm or less is preferable as a particle size of a magnetic particle, and that ranging from 30 μm to 150 μm is especially preferable.

The magnetic particles as those mentioned above are obtained by selecting particle sizes through the average particle size selecting means known widely in the past from the particles of ferromagnetic substance such as metal including iron, chromium, nickel or cobalt identical to those in magnetic carrier particles in the conventional two-component developer, or such as a compound or an alloy thereof including, for example, tri-iron tetroxide, r-ferric oxide, chromium dioxide, manganese oxide, ferrite, or manganese-copper alloy, or from the particles obtained either by covering the surface of the ferromagnetic substance particle mentioned above with resins such as styrene resin, vinyl resin, ethylene resin, rosin-denatured resin, acrylic resin, polyamide resin, epoxy resin or polyester resin, or by preparing with resins containing dispersed magnetic substance fine particles.

Incidentally, a magnetic particle formed to be spherical offers an effect that a particle layer formed on a magnetic-particle-carrier is uniform and it is possible to impress high bias voltage uniformly on the magnetic-particle-carrier. Namely, a magnetic particle formed to be spherical offers the following effects:

(1) though a magnetic particle tends to be subjected to magnetization adsorption in the major axis direction, direction-taking properties are lost due to sphering, and thereby a layer is formed uniformly without occurrence of a localized area where the resistance is low and unevenness of a layer thickness, and (2) due to high resistance of a magnetic particle, an edge portion as observed in a conventional particle is lost, and thereby no concentration of an electric field to an edge portion occurs, resulting in that the surface of the photoreceptor drum 10 is subjected to uniform discharge and no uneven charging even when high bias voltage is impressed on a magnetic-particle-carrier of a magnetic particle.

As a spherical particle having the effect mentioned above, a conductive magnetic particle having electrical resistivity of a magnetic particle ranging from $10^3$ Ω·cm to $10^{12}$ Ω·cm, especially from $10^5$ Ω·cm to $10^9$ Ω·cm is preferable. This electrical resistivity is represented by a value obtained by reading an electric current value after particles are put in a container having a sectional area of 0.50 $cm^2$ and tapped, a load of 1 $kg/cm^2$ is applied on the tapped particles, and voltage that causes an electric field of 1,000 V/cm between the load and a bottom electrode is impressed. Under the condition that the electrical resistivity is low, when bias voltage is applied on a magnetic-particle-carrier, electric charges are injected in a magnetic particle, causing the magnetic particle to stick easily to the surface of the photoreceptor drum 10 or causing dielectric breakdown of the photoreceptor drum 10 caused by bias voltage to occur easily. When electrical resistivity is high, charges are not injected and no charging is carried out.

Further, a preferable magnetic particle has a small specific gravity and an appropriate maximum magnetization so that a magnetic brush composed of magnetic particles of that kind may be moved nimbly without scattering outside. To be concrete, it has been found that good results are obtained by using one having true specific gravity of not more than 6 and maximum magnetization of 30–100 emu/g especially of 40–80 emu/g.

Summarizing the foregoing, optimum conditions of magnetic particles are that the ratio of the major axis to the minor axis in sphering is not more than 3 at least, a protrusion such as an acicular portion or an edge portion does not exist, and electrical resistivity is in a range of $10^5$ Ω·cm–$10^9$ Ω·cm. A magnetic particle having the spherical form mentioned above can be manufactured by selecting spherical magnetic substance particles as far as possible, by using fine particles of magnetic substance as far as possible and providing sphering processing after formation of distributed resin particles, or by forming distributed resin particles through a spray dry method.

The foregoing represents general conditions of magnetic particles, and next explanation is for conditions of a magnetic-particle-carrier for magnetic particles that is provided with a layer of particles formed thereon an charges the photoreceptor drum 10.

As a magnetic-particle-carrier for magnetic particles, a conductive magnetic-particle-carrier capable of being impressed with bias voltage is used, and one having the structure wherein a magnet object with plural magnetic poles is provided inside a conductive charging sleeve on which a layer of particles is formed is used preferably in particular. In such magnetic-particle-carrier, a layer of particles formed on the surface of the conductive charging sleeve moves while rising and falling like a wave due to the relative rotation against the magnet object. Therefore, fresh magnetic particles are supplied successively. Thus, slight unevenness in layer thickness of a layer of particles on the surface of the carrier can be covered sufficiently by ups and downs in a shape of a wave mentioned above so that the unevenness may not be practical problem. It is preferable that a mean roughness on the surface of the carrier is 5–30 μm for the stable and uniform conveyance of magnetic particles. When the surface is smooth, sufficient conveyance can not be carried out, and when it is too rough, overcurrent flows from the protrusion on the surface, and either case tends to cause uneven charging. For obtaining the surface roughness mentioned above, spraying or sand blast treatment is preferably used. It is preferable that a diameter of the carrier is in a range of 5.0–20 mm. By ensuring the diameter mentioned above, it is possible to secure the contact area which is necessary for charging. When the contact area is larger than needed, excessively heavy current for charging is required, while when it is small, uneven charging tends to be caused. When the diameter is small as in the foregoing, magnetic particles tend to scatter or to stick to the photoreceptor drum 10, due to a centrifugal force. It is therefore preferable that the linear speed of the carrier is made slow within the following range. It is further preferable that the conveyance speed for magnetic particles caused by rotation of the carrier is identical to or slower than the moving speed of the photoreceptor drum 10. The conveyance direction caused by the rotation of the carrier is preferably the same. When it is in the same direction, uniformity of charging is more excellent than in the opposite direction. However, the invention is not limited to them.

With regard to the thickness of a layer of particles formed on the carrier, the thickness that can be scraped off sufficiently to be a uniform layer by a regulating means is preferable. When magnetic particles in excessive quantity exist on the surface of the carrier in a charging area, magnetic particles are not vibrated sufficiently, wear of a photoreceptor and uneven charging are caused and overcurrent tends to flow, resulting in great torque for driving the carrier, which is a disadvantage. When an amount of magnetic particles existing on the carrier in the charging area is too small, on the contrary, a portion where contact to the photoreceptor drum 10 is insufficient is caused, and sticking of magnetic particles to the photoreceptor drum 10 and uneven charging are caused. After repeated experiments, it was found that preferable amount W of magnetic particles in the charging area is 10–300mg/cm$^2$ and an amount which is especially preferable is 30–150 mg/cm$^2$. Incidentally, the existing amount in this case is a mean value of a magnetic brush in the charging area.

The distance $D_{sd}$ between a magnetic-particle-carrier and photoreceptor drum 10 which is 0.1 mm–5.0 mm is preferable. When the distance D between a magnetic-particle carrier and photoreceptor drum 10 is smaller than 0.1 mm, it is difficult to form an ear of a magnetic brush that conducts uniform charging operation for the distance, and it is impossible to supply sufficient magnetic particles to the charging section, making it impossible to charge stably. When the distance $D_{sd}$ exceeds 5 mm by far, a particle layer is formed coarsely, causing uneven charging to take place easily and sufficient charging can not be obtained. When the distance $D_{sd}$ between a magnetic-particle carrier and photoreceptor drum 10 takes an extreme value as shown above, the thickness of a particle layer on the magnetic-particle-layer can not be adjusted to the appropriate value for the distance. When the distance $D_{sd}$ is in the range of 0.1–5 mm, however, it is possible to make the thickness of a particle layer to be appropriate for the distance so that an ear of a magnetic brush can be formed uniformly. Further, with regard to conveyance amount (W) and distance ($D_{sd}$), the conditions of $300 \leqq W/DI \leqq 3{,}000$ (mg/cm$^3$) were important for charging uniformly, at high speed and stably. When the value of $W/D_{sd}$ was out of this range, it was confirmed that uneven charging took place.

$D_{sd}$ is considered to be a factor for determining the length of a chain of magnetic particles. Electric resistance corresponding to the length of the chain is considered to correspond to easiness of charging and charging speed. On the other hand, W is considered to be a factor determining the density of chains of magnetic particles. It is considered that an increase of the number of chains improves uniformity of charging. In a charging area, however, it is considered that compressed state of chains of magnetic particles is realized when the magnetic particles pass through a narrow gap. In this case, the chains of magnetic particles rub an image forming object while the chains contact each other to be bent and disturbed, while facing the photoreceptor drum 10.

The disturbing conditions are considered to cause no charging streaks and to make the movement of charges easy, thereby to be effective for uniform charging. Namely, when the value of $W/D_{sd}$ corresponding to magnetic particles density is small, chains of magnetic particles are coarse to receive less disturbance, resulting in uneven charging. When the value of $W/D_{sd}$ is large, chains of magnetic particles are not formed sufficiently due to the high degree of packing, and magnetic particles are less disturbed. This prevents the free movement of charges and is considered to be the reason for uneven charging.

When toner is mixed in a magnetic brush, the charging capability is lowered because insulation of toner is high, thus uneven charging is caused. For preventing this problem, it is necessary to lower an amount of charges of toner so that toner may move to an image forming object when charging. When an amount of frictional electrification of toner was adjusted to be 1–20 μC/g with the same charging polarity under the condition that toner was mixed in magnetic particles and toner concentration was adjusted to 1% by weight, it was possible to prevent accumulation of toner in a magnetic brush. The reason for the foregoing is considered that toner sticks to an image forming object when charging even the toner is mixed. It was confirmed that large amount of charges of toner makes it difficult for the toner to leave magnetic particles, while small amount thereof makes it easy for the toner to move electrically to an image forming object.

Next, charging unit 20 of the invention will be explained. In FIG. 1, the numeral 21 represents magnetic particles, 22 represents a charging sleeve that is a carrier for conveying magnetic particles 21 formed with non-magnetic and conductive metal such as aluminum having a diameter of 15 mm, and 23 represents a columnar magnetic object affixed inside the charging sleeve 22. Around the circumference of the columnar magnetic object 23, there are arranged 6 or 8 magnetic poles magnetized in south poles and north poles as shown in the figure so that the surface of the charging sleeve 22 may show 500–1,000 gauss. The charging sleeve is rotatable against magnet object 23, and it is preferably rotated at the peripheral speed being 0.1 times–1.0 time that of photoreceptor drum 10 in the same direction as the photoreceptor drum 10 at the position where the charging sleeve faces the photoreceptor drum 10.

With regard to an angle of a magnetic pole at the charging area, it is preferable that the angle $\theta_1$ extending toward the upstream side from the point which is closest to an image forming object is set to 5°–30°. Further, it is preferable that the angle $\theta_2$ extending toward the downstream side from the aforesaid point is set to 10°–40°, for an outlet of the charging area to leave with a uniform layer formation status. The condition of $\theta_2 > \theta_1$ is further preferable.

The numeral 25 represents a casing that forms a reservoir portion for the aforementioned magnetic particles 21, and inside the casing 25, there are provided the aforementioned charging sleeve 22 and magnetic object 23. At the outlet of the casing 25, there is provided non-magnetic regulating plate 26 that is a regulating member for regulating the throughput of the magnetic particles 21 so that the thickness of the magnetic particles 21 sticking to the charging sleeve 22 to be carried out may be regulated. Distance between the regulating plate 26 and the charging sleeve 22 is adjusted so that an amount of magnetic particles 21, namely an amount of existence of magnetic particles 21 on the charging sleeve 22 at a charging area may be 10–300 mg/cm$^2$, especially preferably 30–150 mg/cm$^2$. The numeral 27 is a stirrer for stirring the magnetic particles 21 to be uniform, 28 is a scraping member to scrape off magnetic particles 21 from the charging sleeve 22, and magnetic particles 21 are always agitated and mixed to be uniform by the stirring member 28 and stirrer 27.

It is possible to set distance $D_{sd}$ with which the charging sleeve 22 faces the photoreceptor drum 10 to be within a range of 0.1–5.0 mm, and when it is narrower than this range, the durability of the photoreceptor drum 10 or the like is lowered early, and it becomes difficult to form magnetic brush 21A composed of magnetic particles 21 which rubs the photoreceptor drum 10 properly. When it is broader, on the contrary, it becomes difficult for the magnetic brush 21A to come into contact with the photoreceptor drum 10 uniformly, namely, to charge the photoreceptor drum 10 uniformly. The distance $D_{sd}$ between the charging sleeve 22 and the photoreceptor drum 10 is filled with the conductive magnetic brush 21A which is regulated in terms of thickness.

The invention is not limited to the example shown in FIG. 1, and it may also include one wherein magnet object 23 having N and S magnetic poles at positions divided equally in the circumferential direction rotates in the direction opposite to that for conveyance of magnetic particles 21 and charging sleeve 22 is either stationary or it rotates in the direction opposite to that of the magnet object 23. The rotating direction of the charging sleeve 22 and the magnet object 23 may also be one which makes the conveyance direction of the magnetic brush 21A located in the position where the charging sleeve 22 faces the photoreceptor drum 10 to be opposite to the moving direction of the photoreceptor drum 10. However, from the viewpoints of uniformity of charging for the photoreceptor drum 10, collectability of the magnetic brush 21A passed through the rubbing position on the photoreceptor drum 10 into container 25, and durability of the photoreceptor drum 10, it is preferable that the aforesaid conveyance direction of the magnetic brush is the same as the moving direction of the photoreceptor drum 10, and the conveyance speed is 0.1–1.0 time the moving speed of the photoreceptor drum 10.

The photoreceptor drum 10 is composed of conductive base material 10*b* and photoreceptor layer 10*a* which covers the surface of the conductive base material, and the conductive base material 10*b* is grounded.

The numerals 61 and 63 represent a power supply for bias voltage that impresses A.C. bias voltage wherein A.C. components are superimposed on D.C. components between the charging sleeve 22 and conductive base material 10*b*, and 61 is a D.C. power supply, 62 is an ammeter detecting a current value of D.C. components, 63 is an A.C. power supply, 70 is CPU of a control section, 71 is ROM wherein there are stored data used when output voltage of the A.C. power supply is controlled, 72 is an analog/digital converter (A/D converter), and 73 is a digital/analog converter (D/A converter). A.C. bias voltage generated by the power supply for bias voltage 61 and 63 is impressed on the above-mentioned charging sleeve 22 through protection resistor R. Incidentally, power supply 61 and 63 is a constant-voltage power supply.

Next, how the above-mentioned charging unit 20 works will be explained as follows.

When the charging sleeve 22 is rotated in the arrowed direction at the peripheral speed that is 0.1–1.0 time that of the photoreceptor drum 10 while rotating the photoreceptor drum 10 in the arrowed direction, a layer of magnetic particles 21 stuck to the charging sleeve 22 and conveyed thereby is regulated in terms of thickness by regulating plate 26 and concurrently with this, the magnetic particles 21 are connected magnetically to be a kind of a brush by lines of magnetic force of magnet object 23 to be a chain form at the position on the charging sleeve 22 where the charging sleeve faces the photoreceptor drum 10, thus the so-called magnetic brush 21A is formed. The magnetic brush 21A is conveyed in the direction of rotation of the charging sleeve 22 and comes into contact with photoreceptor layer 10*a* of the photoreceptor drum 10 and rubs it. Between the charging sleeve 22 and the photoreceptor drum 10, there is formed a vibration electric field produced by the aforesaid A.C. bias voltage. Therefore, smooth injection of charges onto photoreceptor layer 10*a* that has passed through the magnetic brush 21A can be conducted and uniform charging is carried out at high speed.

A.C. components of bias voltage in this case confined in the white are in FIG. 5 is preferable from the viewpoint of stable charging. In FIG. 5, a vertically hatched area is one where dielectric breakdown tends to happen, a obliquely hatched area is one where uneven charging tends to happen, and a dotted low frequency area is one where uneven charging tends to happen because of low frequency. A waveform of A.C. components may also be a rectangular wave or a triangular wave without being limited to a sine wave.

Figure 4:
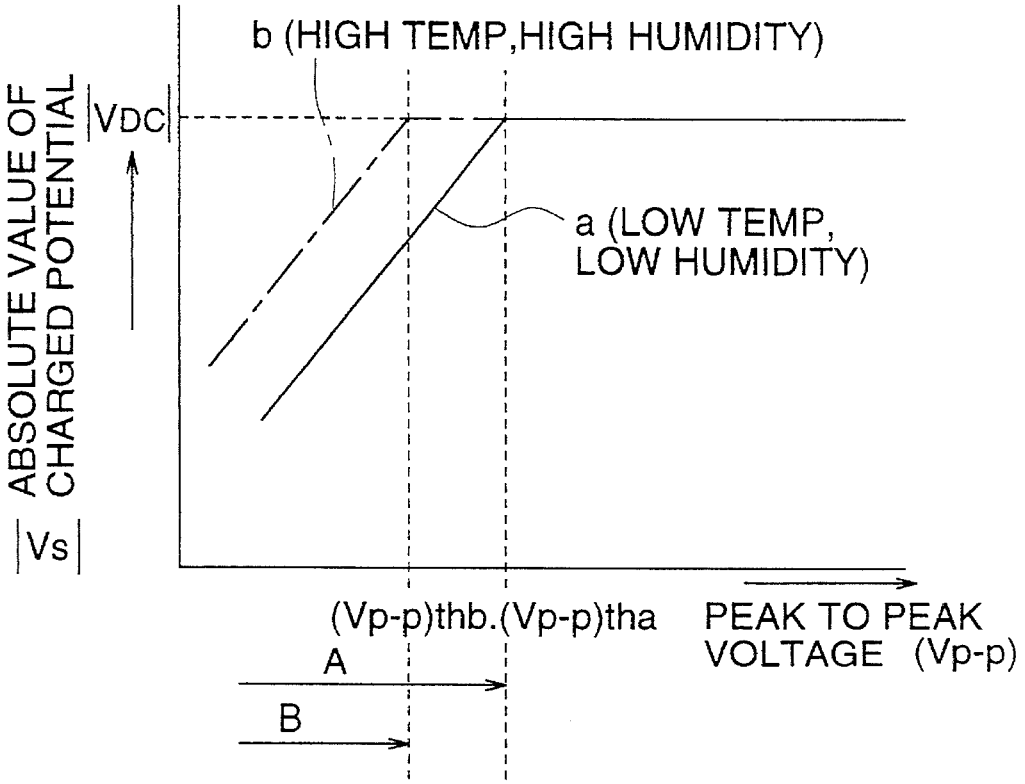
FIG. 4(*a*) is a graph showing relationship between A.C. component voltage of bias voltage and charging voltage.
Figure 4:
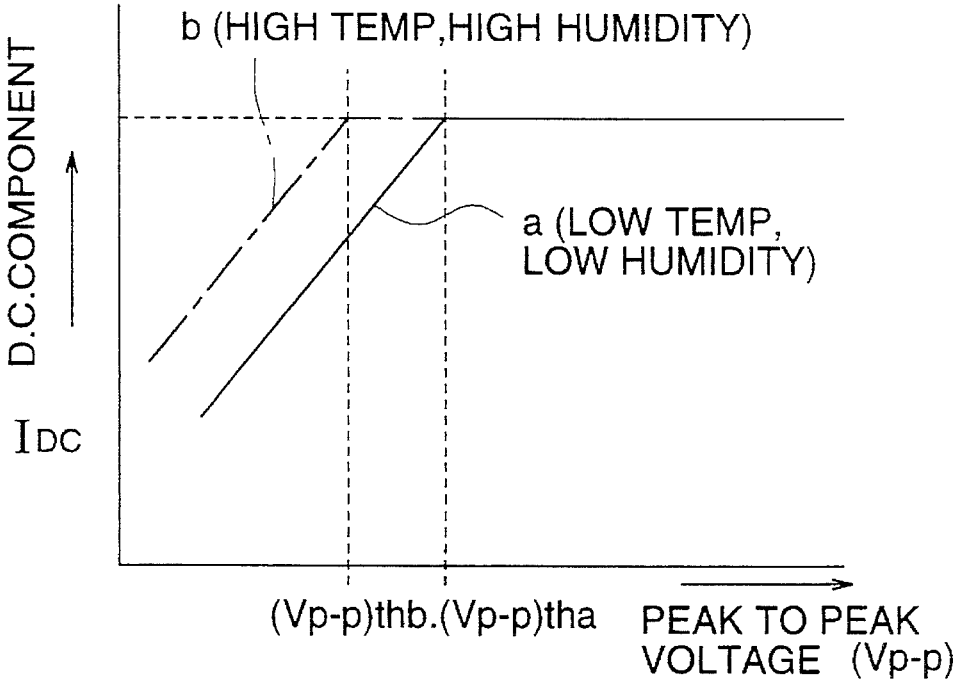

FIG. 4(*a*) represents relationship between peak-to-peak voltage ($V_{P-P}$) Of voltage that corresponds to that of A.C. components and absolute value ($|V_S|$) of charging voltage. In FIG. 4(*a*), the axis of abscissas represents peak-to-peak voltage ($V_{P=P}$) of A.C. bias voltage and the axis of ordinates represents the absolute value ($|V_S|$) of charging voltage for the photoreceptor drum 10. As the peak-to-peak voltage $V_{P-P}$ becomes higher, the absolute value ($|V_S|$) of charging voltage grows greater, and the charging voltage $V_S$ is saturated with its peak-to-peak voltage that is constant threshold value $(V_{P-P})$th and is equal to value VDC Of D.C. components of bias voltage, and even when the peak-to-peak voltage $V_{P-P}$ is higher than that, the charging voltage does not change, which is a special characteristic. Electric resistance of magnetic particle 21 varies depending on environmental conditions, and it is high under the low temperature and low humidity, while it is low under the high temperature and high humidity. Therefore, the characteristics curve is positioned at the right side as shown by (a) indicated with a solid line in the case of the low temperature and low humidity, while it is positioned at the left side as shown as shown by (b) indicated with a one-dot chain line in the case of the high temperature and high humidity, and the threshold value $(V_{P-P})$th of the peak-to-peak voltage is shown to be $(V_{P-P})$tha and $(V_{P-P})$thb which are different each other. It has been found after experiments that the preferable charging conditions under various conditions can be obtained with peak-to-peak voltage $V_{P-P}$ of A.C. components that satisfies the condition of $0.8\times(V_{P-P})\text{th} \leqq V_{P-P} \leqq 1.5\times(V_{P-P})\text{th}$. The peak-to-peak voltage $V_{P-P}$ lower than the foregoing causes uneven charging and sticking of magnetic particles, and that $V_{P-P}$ higher than the foregoing tends to cause breakdown. It was further cleared that charging voltage $V_S$ is proportional to current value $I_{DC}$ Of D.C. components as shown in FIG. 4(*b*) . Namely, current value $I_{DC}$ of D.C. components is increased as peak-to-peak voltage $V_{P-P}$ increases, and when the peak-to-peak voltage is $(V_{P-P})$th or more, the current value $I_{DC}$ changes to be saturated. Namely, for the change of A.C. components, current value $I_{DC}$ shows the change which is mostly the same as a and b in FIG. 4. In accordance with this characteristic, current value $I_{DC}$ of D.C. components is detected and the detected value is used for estimation of threshold value $(V_{P-P})$th of peak-to-peak voltage of A.C. components, thus it is possible to control the charging conditions depending on environmental changes by controlling peak-to-peak voltage $V_{P-P}$ to be impressed. Namely, current value $I_{DC}$ detected by ammeter 62 when specific $V_{P-P}$ that is lower than $(V_{P-P})$th is impressed is converted to a digital value by A/D converter 72, and then is inputted in CPU 70. This current value is compared with a current reference value stored by CPU 70 as data in ROM 71, and threshold value $(V_{P-P})$th of peak-to-peak voltage that is A.C. voltage is calculated. This calculated value multiplied by 1.2, for example, is determined to be $V_{P-P}$ to be impressed, and control signals are outputted from CPU 70. The control signals are converted to analog values by D/A converter 73 and are sent to A.C. power supply 63, thus peak-to-peak voltage $V_{P-P}$ in the voltage is outputted. In the case when a value obtained by multiplying the calculated $(V_{P-P})$th by 0.9 is selected, namely, in the case corresponding to the range lower than the aforesaid threshold value $(V_{P-P})$ tha or $(V_{P-P})$thb (the range of A or B in FIG. 4(*a*)) too, it is possible to control by selecting peak-to-peak voltage $V_{P-P}$ so that current value $I_{DC}$ of D.C. components of A.C. bias voltage may always be constant. Therefore, it is possible to keep charging voltage $V_S$ for the photoreceptor drum 10 constant, and to maintain stably the absolute value $|V_S|$ of the charging voltage to be smaller than absolute value $|V_{DC}|$ of voltage of D.C. components.

Since the charging voltage for the photoreceptor drum 10 is determined by current value $I_{DC}$ of D.C. components in A.C. bias voltage as described above, it is possible to change the charging voltage by changing current value $I_{DC}$. Therefore, in the case of an image forming apparatus wherein the charging voltage needs to be changed, it is possible to change the charging voltage easily without making the apparatus to be complicated, by preparing some reference values for current value $I_{DC}$ and by switching them for use.

Further, in the case wherein the voltage difference is established to satisfy the condition of $|V_{DC}|-|V_S|>0$, and charging polarity of magnetic particles 21 used in charging unit 20 for frictional electrification with mixed toner therein is set to be identical to the polarity of the aforesaid D.C. components, even when toner tries to enter magnetic brush 21A, the toner is moved to the photoreceptor drum 10 due to the above-mentioned voltage difference $(|V_{DC}|-|V_S|)$ without entering the magnetic brush 21A, which is an advantageous point.

It was found after experiments that the absolute value $|V_{DC}|$ of the aforesaid D.C. components voltage is required to be greater than the absolute value $|V_S|$ of charging voltage by 20 V for moving toner from magnetic brush 21A to the photoreceptor drum 10, and it is required to be not higher than 300 V for preventing magnetic particles 21 from sticking to the photoreceptor drum 10. Namely, the condition of $20\ V \leqq (|V_{DC}|-|V_S|) \leqq 400\ V$ can prevent that magnetic particles 21 stick to the photoreceptor drum 10 and toner enters magnetic brush 21A.

When a vibration electric field is formed by impressing A.C. bias voltage on magnetic brush 21A and absolute value $|V_S|$ of charging voltage for photoreceptor layer 10*a* is set to be smaller than absolute value $|V_{DC}|$ of D.C. components voltage of the aforesaid A.C. bias voltage, it is possible to prevent magnetic particles 21 from sticking to the photoreceptor drum 10 and to carry out uniform charging at high speed extremely stably with low bias voltage.

As magnetic particles 21 in the above-mentioned example, spherical ferrite particles which are coated so that they may be conductive are used. In addition to that, it is also possible to use conductive magnetic resin particles obtained through thermal kneading of main components of magnetic particles and resins and through crushing them. Excellent charging requires conditions that an external shape is truly spherical and a particle size is 50 μm, specific resistance is adjusted to be $10^8$ Ω·cm, and frictional electrification with toner is −5.0 μC/g under the condition of toner concentration of 1% by weight.

Incidentally, it is preferable to neutralize the photoreceptor drum 10 by the use of charging unit 20 in the present example when no charging is carried out. Neutralizing can be carried out by making only D.C. components of bias voltage to be zero. After forming images, the photoreceptor drum 10 is neutralized by impressing only A.C. components after making D.C. components to be zero while the photoreceptor drum 10 is rotating. At the moment when neutralizing of the photoreceptor drum 10 is completed, impressing of A.C. components is stopped. After that, rotation of a charging sleeve and an image forming object is stopped. Incidentally, when starting charging, the order is opposite to the foregoing. Namely, after rotation of the charging sleeve and a photoreceptor, A.C. components are impressed and then D.C. components are impressed.

There will be shown as follows a method for controlling at a higher accuracy level. From the further study, it is understood that charging characteristics are related not only to temperature.humidity characteristics of magnetic particles but also to the following.

1) Variation on the charging unit side: Difference between lots of magnetic particles, temperature.humidity characteristics, toner mixing, and setting conditions for charging unit (distance between a charging sleeve and an image forming object, distance between a charging sleeve and a regulating plate, and angles of magnetic poles)

2) Variation on the image forming object side: A value of current value $I_{DC}$ varies depending on thickness of an image forming object layer, temperature.humidity characteristics, and fatigue characteristics. For securing stability of charging, it is necessary to obtain threshold value $(V_{P-P})$th of peak-to-peak voltage that varies more accurately than current value $I_{DC}$.

1. Method for establishing target values

In the method explained previously, $(V_{P-P})$th is obtained from the difference between $I_{DC}$ which flew under the specific $V_{P-P}$ lower than $(V_{P-P})$th and $I_{DC}$ which is a target value given in advance. The target value $I_{DC}$ given in advance is controlled accurately by the use of the value that changes depending on a photoreceptor and temperature.humidity.

In addition to the foregoing, it is also possible to set $I_{DC}$ which flowed under $V_{P-P}$ which is sufficiently higher than $(V_{P-P})$th as the target value $I_{DC}$. In this way, it is possible to set target value $I_{DC}$ each time.

Incidentally, when the obtained $(V_{P-P})$th is out of the specified value, charging is prohibited.

For changing charging voltage, voltage $V_{DC}$ of D.C. components is changed. Following the change of the voltage $V_{DC}$, $I_{DC}$ also changes. Therefore, it is necessary to prepare the relevant ROM table when using the target value $I_{DC}$ given in advance.

When setting $I_{DC}$ that flew under $V_{P-P}$ which is sufficiently higher than $(V_{P-P})$th as the target value $I_{DC}$, the ROM table is not necessary.

$V_{P-P}$ to be impressed is obtained by multiplying the $(V_{P-P})$ thus obtained with the aforesaid constant.

In place of the table, it is possible to obtain $(V_{P-P})$th through calculation wherein the calculation expression $(V_{P-P})$th=(target value $I_{DC}$ /flowed $I_{DC}$)×impressed $V_{P-P}$+C is used provided, however, that C is a constant.

2. Scanning method

The change of $I_{DC}$ is measured while $V_{P-P}$ is being changed.

$V_{P-P}$ corresponding to the point where $I_{DC}$ is saturated (an amount of change of $I_{DC}$ arrives at the specified value or less) is made to be $(V_{P-P})$th, and this value multiplied with the aforesaid constant is made to be $V_{P-P}$ to be impressed.

When $V_{P-P}$ is out of the specified value, charging is prohibited.

For changing charging voltage, $V_{DC}$ is changed. In this case, $I_{DC}$ also changes, but in this method, determination is made based on an inflection point of $I_{DC}$ change for $V_{P-P}$.

Therefore, this method has a specific feature that it is hardly affected by variation of a charging unit and an image forming object.

(EXAMPLE 2)

Figure 2:
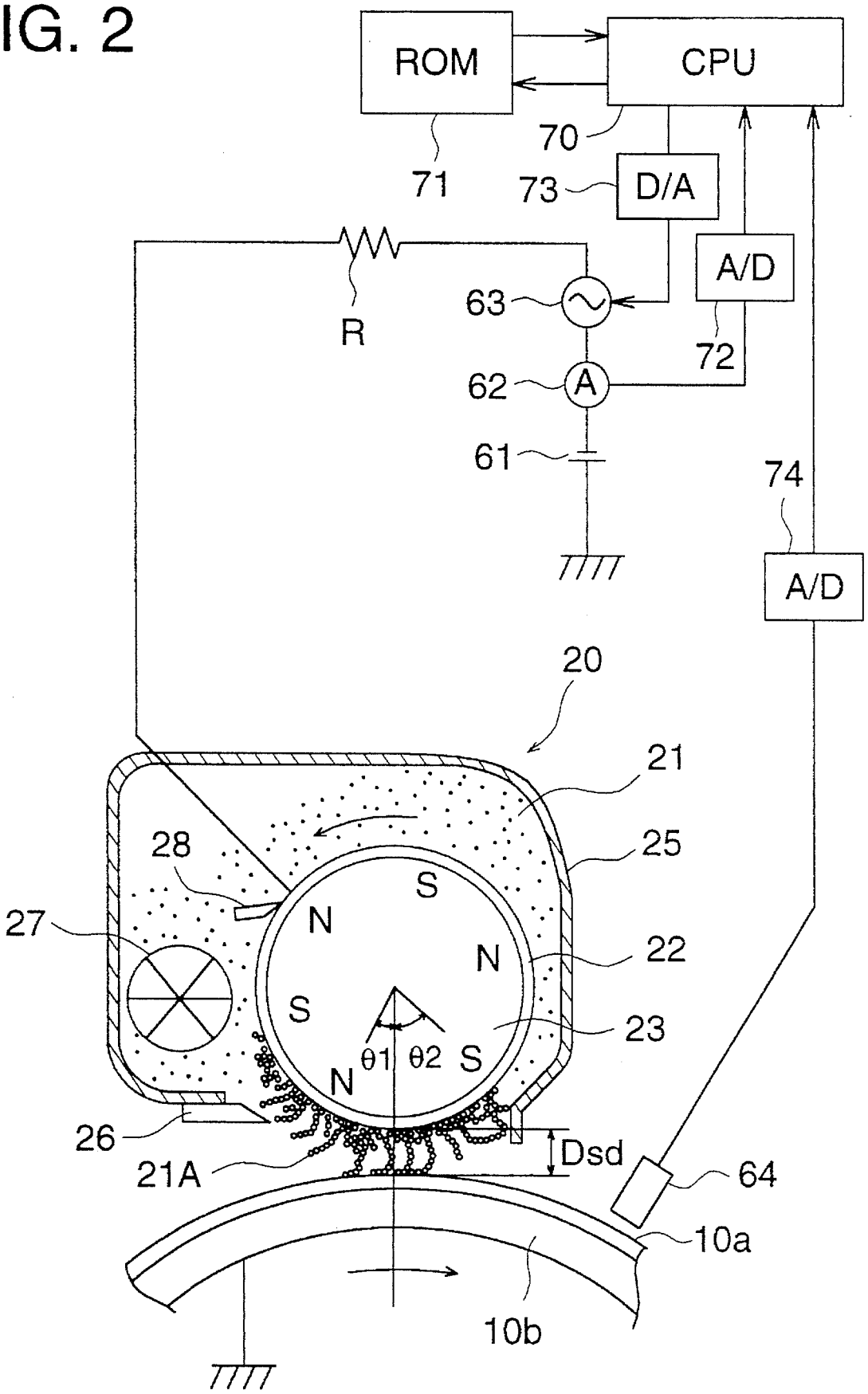
FIG. 2 is an enlarged sectional view showing another example of the charging unit of the invention.

FIG. 2 is an enlarged sectional view showing another example of a charging unit of the invention. Items in FIG. 2 which are the same as those of a charging unit in FIG. 1 are given the same symbols as in FIG. 1 and detailed explanation therefor will be omitted. In the figure, 64 represents a voltmeter provided at the downstream side of charging unit 20 for the purpose of detecting charging voltage for the photoreceptor drum 10, and 74 is an A/D converter that converts output of the voltmeter 64 on an analog/digital basis. Output signals of the voltmeter 64 generated when specific $V_{P-P}$ lower than $(V_{P-P})$th is impressed are inputted in CPU 70 after being converted to digital values by A/D converter 74, and then compared at CPU 70 with the voltage reference value stored in ROM 71 as data, thus threshold value $(V_{P-P})$th of peak-to-peak voltage which is A.C. voltage is calculated. This calculated value multiplied by the aforesaid specific magnification is determined as $V_{P-P}$ to be impressed, and control signals are outputted from CPU 70. The control signals are converted to analog values by D/A converter 73, then sent to A.C. power supply 63, and peak-to-peak voltage $V_{P-P}$ is adjusted in accordance with threshold value $(V_{P-P})$th that changes corresponding to the change in charging conditions. Therefore, it is possible to control so that charging voltage $V_S$ for the photoreceptor drum 10 may always be maintained constant, and to maintain stably even when the absolute value $|V_S|$ of charging voltage is made smaller than the absolute value $|V_{DC}|$ of voltage of D.C. components.

A method for the highly accurate control will be shown below.

For stable charging, it is necessary to obtain threshold value $(V_{P-P})$th that varies accurately from charging voltage $V_S$.

1. Target value setting method

In the method explained previously, $(V_{P-P})$th is obtained from the difference between $V_S$ obtained by charging under specific $V_{P-P}$ lower than $(V_{P-P})$th and target charging voltage $V_S$ given in advance.

The target value $V_S$ given in advance is controlled accurately by the use of the value that changes depending on a photoreceptor and temperature.humidity.

In addition to the foregoing, it is also possible to set $V_S$ which is charged under $V_{P-P}$ which is sufficiently higher than $(V_{P-P})$th as the target value $V_S$. In this way, it is possible to set target value $V_S$ each time.

Incidentally, when the obtained $(V_{P-P})$th is out of the specified value, charging is prohibited.

For changing charging voltage, voltage $V_{DC}$ of D.C. components is changed.

It is necessary to prepare the relevant ROM table when using the target value $V_S$ given in advance.

When setting $V_S$ obtained in charging under $V_{P-P}$ which is sufficiently higher than $(V_{P-P})$th as the target value $V_S$, the ROM table is not necessary.

$V_{P-P}$ to be impressed is obtained by multiplying the $(V_{P-P})$ thus obtained with the aforesaid constant.

In place of the table, it is possible to obtain $(V_{P-P})$th through calculation wherein the calculation expression $(V_{P-P})$th=(target value $V_S$/charged $V_S$)×impressed $V_{P-P}$ +C is used, provided, however, that C is a constant.

2. Scanning method

The change of $V_S$ is measured while $V_{P-P}$ is being changed.

$V_{P-P}$ corresponding to the point where $V_S$ is saturated (an amount of change of $V_S$ arrives at the special value or less) is made to be $(V_{P-P})$th, and this value multiplied with the aforesaid constant is made to be $V_{P-P}$ to be impressed.

When $V_{P-P}$ is out of the specified value, charging is prohibited.

For changing voltage, $V_{DC}$ is changed. In this case, $V_S$ also changes, but in this method, determination is made based on an inflection point of Vs change for $V_{P-P}$. Therefore, this method has a specific feature that it is hardly affected by variation of a charging unit and an image forming object.

In the case of the foregoing, it is possible to eliminate ammeter 62. However, it is further possible to control charging voltage surely through a method wherein current value $I_{DC}$ detected by ammeter 62 is also fed back to CPU 70 through A/D converter 72 and then is combined with feed back by means of the aforesaid ammeter 64. For example, output signals of ammeter 62 are compared with a current reference value first, and thereby peak-to-peak voltage $V_{P-P}$ of A.C. power supply 63 is controlled, and then the charged voltage on the photoreceptor drum 10 charged thereafter is detected by voltmeter 64, and its output signals are compared with a voltage reference value. When the difference is within a tolerance, the aforesaid reference value is left as it is, and when the difference exceeds the tolerance, the reference value is reset, both for controlling the charging voltage. Thus, sure control of charging voltage can be carried out.

A charging method of the invention is preferable for a magnetic brush, but it can be applied also to, voltage stabilizing control for roller charging and for fur brush charging, without being limited to the magnetic brush. Setting of these $V_{P-P}$ may be made for each image forming. However, it is possible to prevent instability of charging conditions caused by fluctuation of $(V_{P-P})$th during continuous printing by setting for the specific number of prints.

In the charging method of the invention, even when environmental conditions change and resistance of a charging member changes accordingly, peak-to-peak voltage $V_{P-P}$ representing A.C. components of bias voltage is changed in accordance with a current value of D.C. components of the bias voltage and thereby the ratio of $V_{P-P}$ to $(V_{P-P})$th is made to be constant. Therefore, it is possible to keep always the charged voltage of an image forming object constant with preferable $V_{P-P}$, without impressing excessive $V_{P-P}$. Further, a magnetic brush is free from adhesion of magnetic particles to a photoreceptor and from change in charging efficiency despite high temperature and high humidity or low temperature ad low humidity, and it is possible to provide a charging unit with a magnetic brush capable of charging uniformly at high speed without causing uneven charging.

What is claimed is:

1. An image forming apparatus, comprising:

an image forming member on which an electrostatic latent image is formed;

a charging member adapted to come in contact with the image forming member, whereby the image forming member is charged to a charged voltage;

an electric source to apply an A.C. voltage and a D.C. voltage onto the charging member;

first voltage changing means for changing an output value of the A.C. voltage of the electric source;

measuring means for measuring a D.C. current supplied to the charging member;

threshold value detection means for detecting a threshold value of the D.C. current from measuring results of the D.C. current which are measured by the measuring means while the output value of the A.C. voltage is changed within a predetermined range by the first voltage changing means; and setting means for setting the output value of the A.C. voltage in accordance with the threshold value detected by the threshold value detection means.

2. The image forming apparatus of claim 1, wherein the charging member comprises a sleeve and a magnetic brush which includes magnetic particles on the sleeve.

3. The image forming apparatus of claim 1, wherein the charging member comprises a charging roller.

4. The image forming apparatus of claim 1, wherein the setting means sets the threshold value $(V_{p-p})_{th}$ and the output value of the A.C. voltage so as to satisfy:

$$.8\times(V_{p-p})_{th}\leqq(V_{p-p})\leqq.5\times(V_{p-p})_{th}$$

5. The image forming apparatus of claim 1, wherein the D.C. voltage is a constant voltage.

6. The image forming apparatus of claim 1, further comprising second voltage changing means for changing the charged voltage on the image forming member.

7. An image forming apparatus, comprising:

an image forming member on which an electrostatic latent image is formed;

a charging member adapted to come in contact with the image forming member, whereby the image forming member is charged to a charged voltage;

an electric source to apply an A.C. voltage and a D.C. voltage onto the charging member;

first voltage changing means for changing an output value of the A.C. voltage of the electric source;

measuring means for measuring the charged voltage on the image forming member;

threshold value detection means for detecting a threshold value of the charged voltage from measuring results of the charged voltage which are measured by the measuring means while the output value of the A.C. voltage is changed within a predetermined range by the first voltage changing means; and setting means for setting the output value of the A.C. voltage in accordance with the threshold value detected by the threshold value detection means.

8. The image forming apparatus of claim 7, wherein the charging member comprises a sleeve and a magnetic brush which includes magnetic particles on the sleeve.

9. The image forming apparatus of claim 7, wherein the charging member comprises a charging roller.

10. The image forming apparatus of claim 7, wherein the setting means sets the threshold value $(V_{p-p})_{th}$ and the output value of the A.C. voltage so as to satisfy:

$$.8\times(V_{p-p})_{th}\leqq(V_{p-p})\leqq.5\times(V_{p-p})_{th}$$

11. The image forming apparatus of claim 7, wherein the D.C. voltage is a constant voltage.

12. The image forming apparatus of claim 7, further comprising second voltage changing means for changing the charged voltage on the image forming member.

* * * * *